US005460417A

United States Patent [19]

Zuckerman

[11] Patent Number: 5,460,417

[45] Date of Patent: Oct. 24, 1995

[54] TUBULAR LOCK ASSEMBLY

[75] Inventor: Martin Zuckerman, Villa Park, Calif.

[73] Assignee: Emhart Inc., Newark, Del.

[21] Appl. No.: 283,461

[22] Filed: Aug. 3, 1994

[51] Int. Cl.[6] ..... E05C 1/10

[52] U.S. Cl. ..... 292/175; 292/169.14; 292/359

[58] Field of Search ..... 292/169.14, 169.15, 292/169.16, 169.23, 175, 173, 336.5, 359, DIG. 30

[56] References Cited

U.S. PATENT DOCUMENTS 4,169,618 10/1979 Potter ..... 292/169.15
4,470,279 9/1984 Neary et al. ..... 292/169.14 X
4,502,720 3/1985 Fayerman et al. ..... 292/169.16 X
5,125,696 6/1992 Robida et al. ..... 292/169.16
5,177,987 1/1993 Shen ..... 292/336.3 X
5,232,255 8/1993 Palmer et al. ..... 292/359 X
5,335,948 8/1994 Norton, II et al. ..... 292/169.23
5,335,950 8/1994 Mirshafiee et al. ..... 292/169.23 X

*Primary Examiner*—Peter M. Cuomo
*Assistant Examiner*—Monica E. Millner
*Attorney, Agent, or Firm*—Spencer T. Smith

[57] ABSTRACT

A tubular lock assembly is provided where rotation of the interior operator in either direction rotates a half round which operates the latch. The interior operator has a push button which can lock the exterior operator and mechanism is provided which releases the push button whenever the operator is rotated in either direction to open the door.

4 Claims, 8 Drawing Sheets

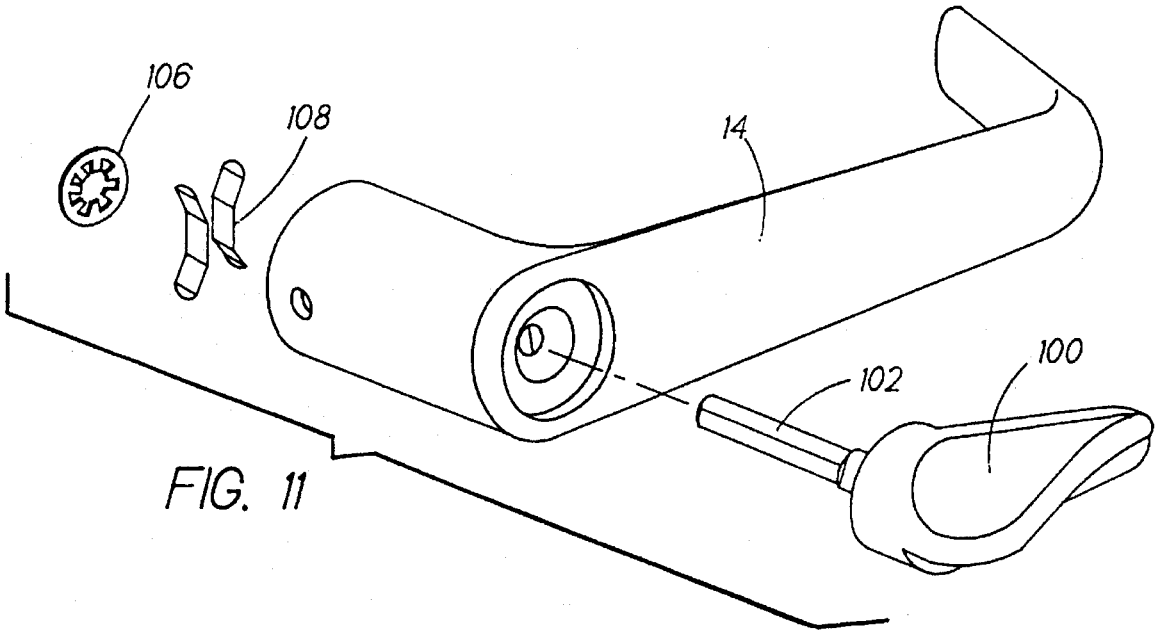
FIG. 11
FIG. 12
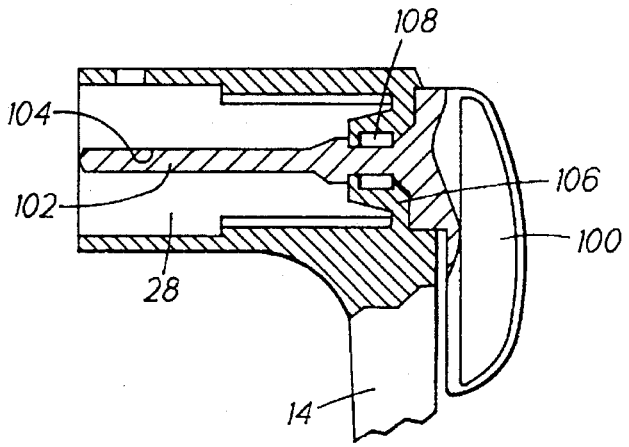

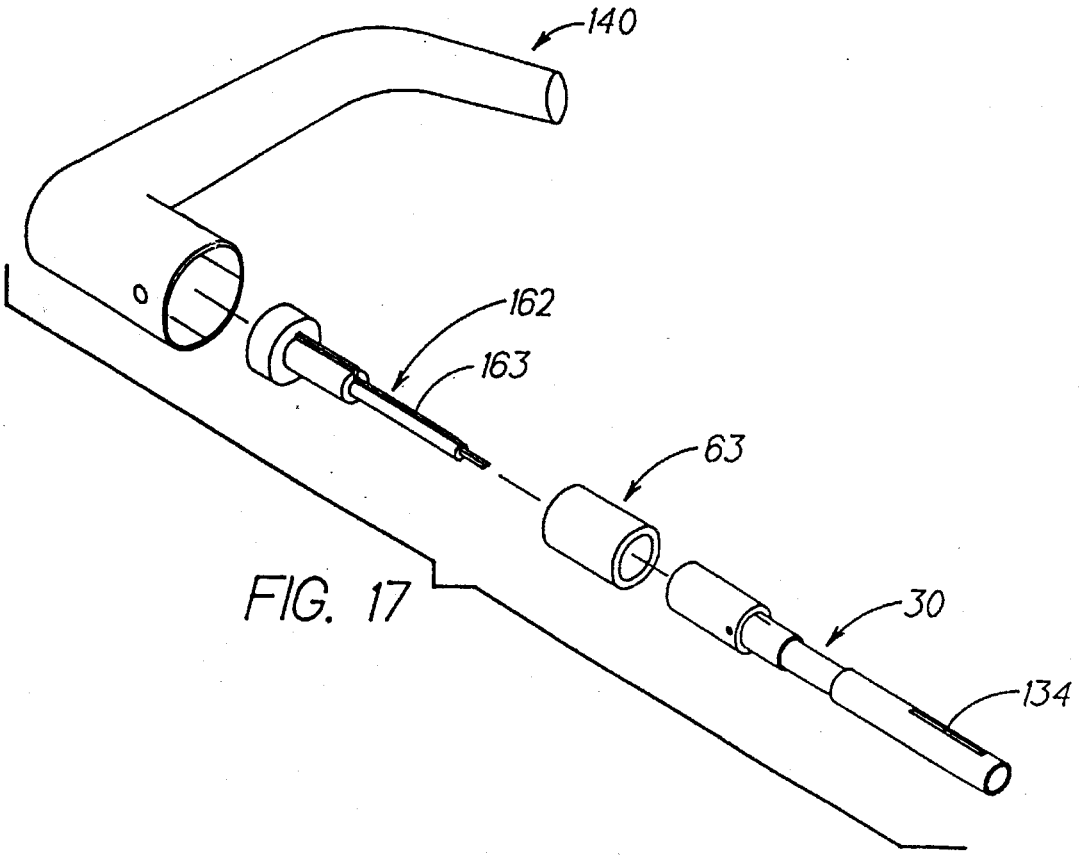
FIG. 17
FIG. 18
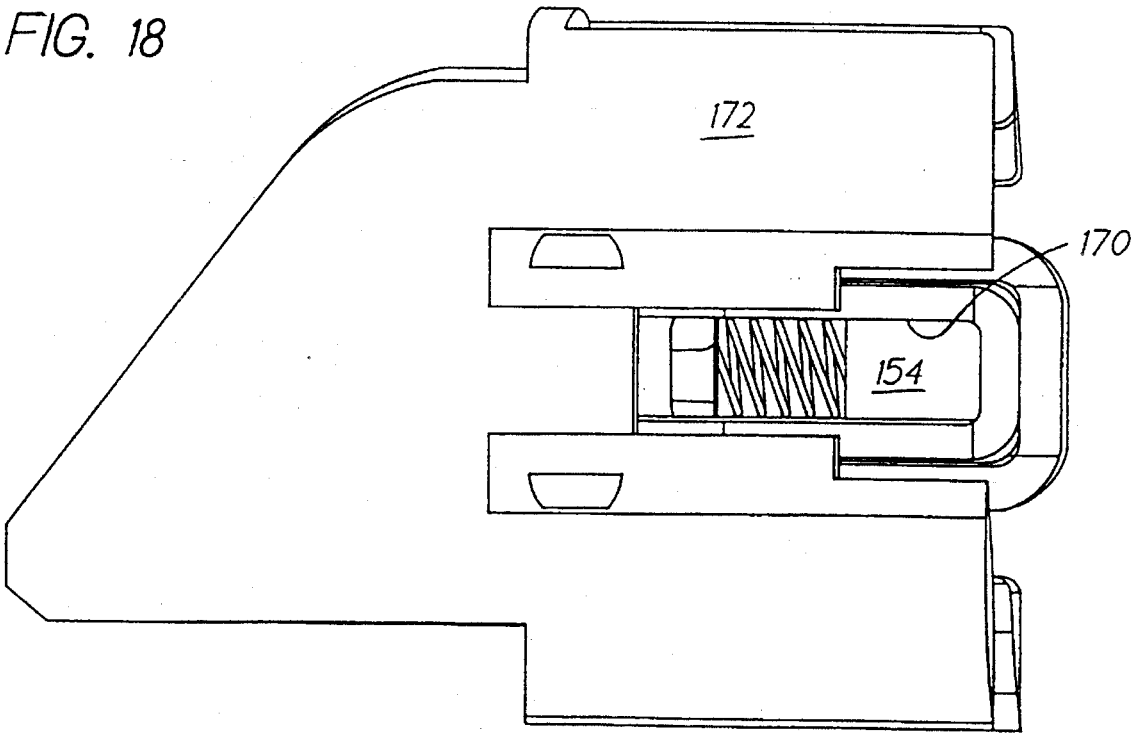

TUBULAR LOCK ASSEMBLY

The present invention relates to tubular lock assemblies which utilize half round sleeves to operate the latch mechanism.

U.S. Pat. Nos. 5,125,696 and 5,269,162 disclose a type of tubular lock assembly in which a half round sleeve is secured to the interior and exterior operators. When the interior operator or an unlocked exterior operator is operated (rotated), the associated sleeve rotates to open the latch. When the exterior operator is locked, rotation is prevented so that the half round associated with that operator cannot rotate to open the latch.

It is an object of the present invention to provide a push button on the interior operator of such a tubular lock assembly to secure privacy when desired that can be released by turning the operator in either direction.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings:

FIG. 11 is an oblique, separated view of the interior operator having a turn button; and FIG. 12 is a view taken at 12—12 of FIG. 11.

FIG. 17 is an oblique separated view of an exterior emergency entrance operator;

FIG. 18 is a top view of the bolt portion of the latch mechanism.

Figure 1:
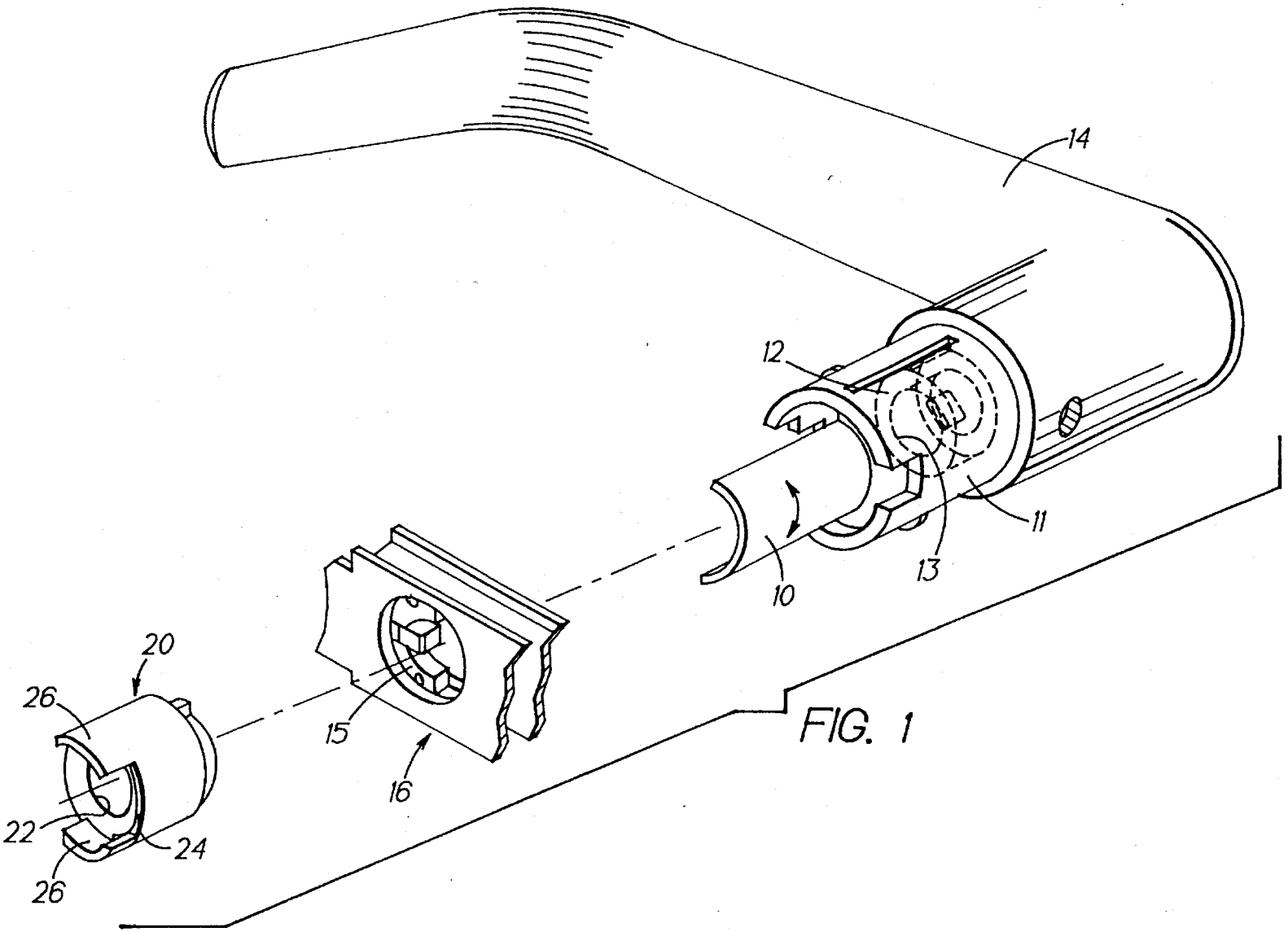
FIG. 1 is an oblique view of a half round of an interior operator assembly of a tubular lock assembly.
Figure 3:
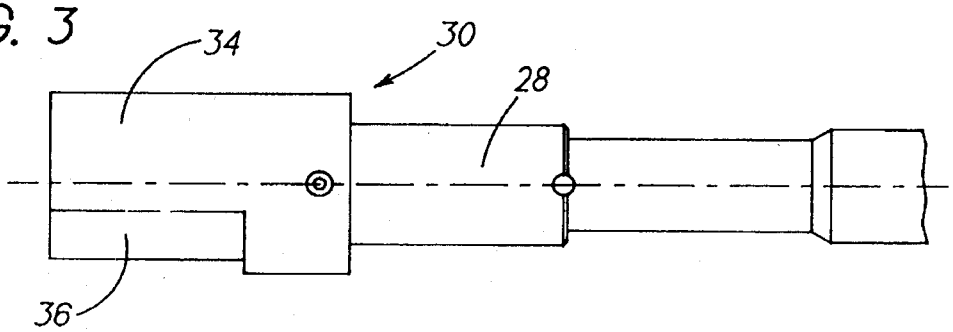
FIG. 3 is a view taken at 3—3 of FIG. 2.
Figure 4:
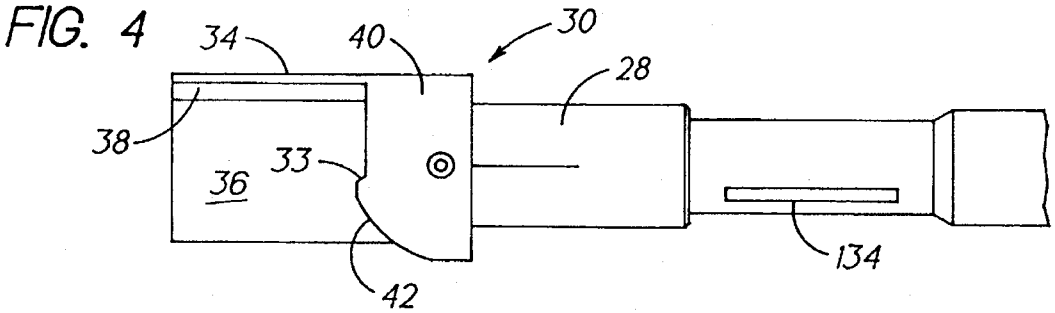
FIG. 4 is a view taken at 4—4 of FIG. 2.
Figure 5:
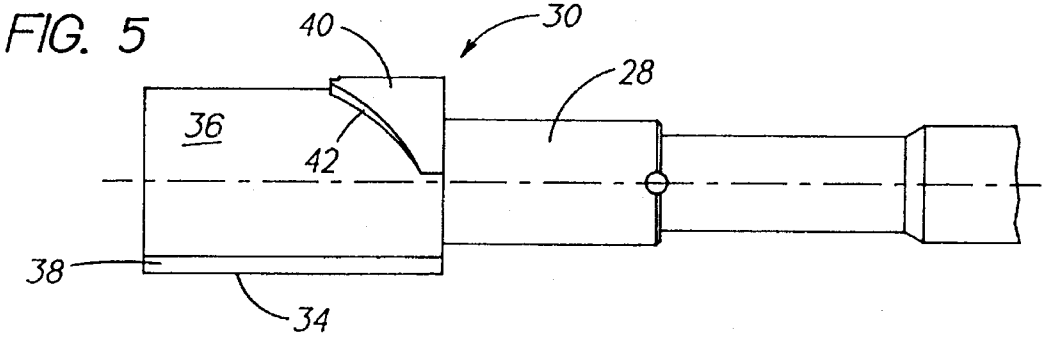
FIG. 5 is a view taken at 5—5 of FIG. 2.
Figure 2:
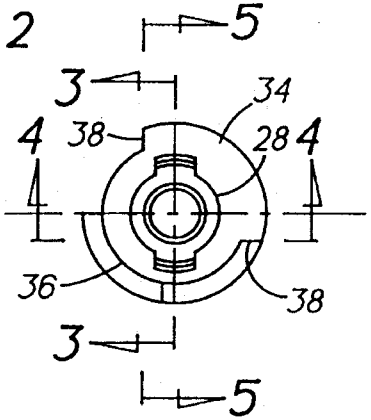
FIG. 2 is an end view of a tubular cam positioned on a supporting rod.
Figure 6:
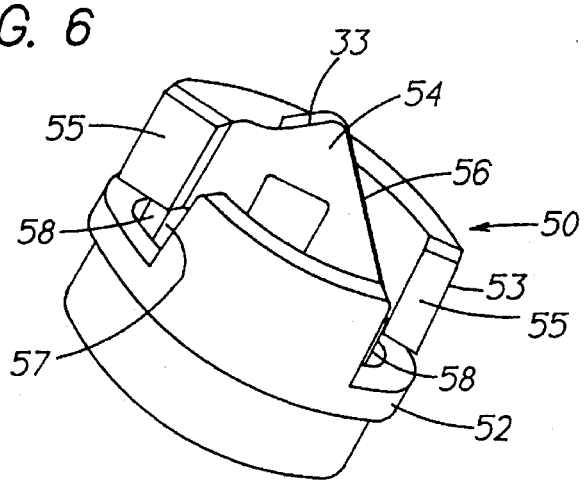
FIG. 6 is an oblique view looking into a cam follower which is received by the cam.

The interior operator (handle) assembly has a sleeve having a half round portion 10 at one end and a cylindrical portion 11 at the other end supporting a plastic bushing 12 having an axial thru-bore 13. This cylindrical end 11 is secured to the interior operator 14. When this operator is rotated in either direction from a neutral orientation this half round portion 10 will engage a retractor slide 15 of a conventional latch assembly 16 (the side surfaces of the half round 10 are in abutting relationship with side surfaces of the retractor slide 15 when the interior operator is in the neutral position) to retract the latch bolt 172 (FIG. 18).

Received on the half round portion 10 is a cylindrical coupling 20 which has an axial thru-bore 22, an axially extending half round receiving slot 24 which extends completely through the coupling, and a pair of axially forwardly (towards the exterior operator) projecting coupling tangs 26. Extending through the axial thru-bore of the coupling 20, the latch assembly 16 and extending into the bushing bore 13 is the spindle 28 (FIGS. 2–5) of a cam assembly 30. A cylindrical cam support 32 having an enlarged portion 34 and a circumferentially continuous reduced diameter portion 36, which together define circumferentially spaced opposed axially extending steps or stops 38, is secured to the forward end of the spindle and a cam 40 having a helical camming surface 42 is secured to the reduced diameter portion 36. The half round portion 10 of the interior operator assembly is inserted into the half round receiving slot 24 in the coupling so that the interior operator and the coupling will rotate together.

Figure 7:
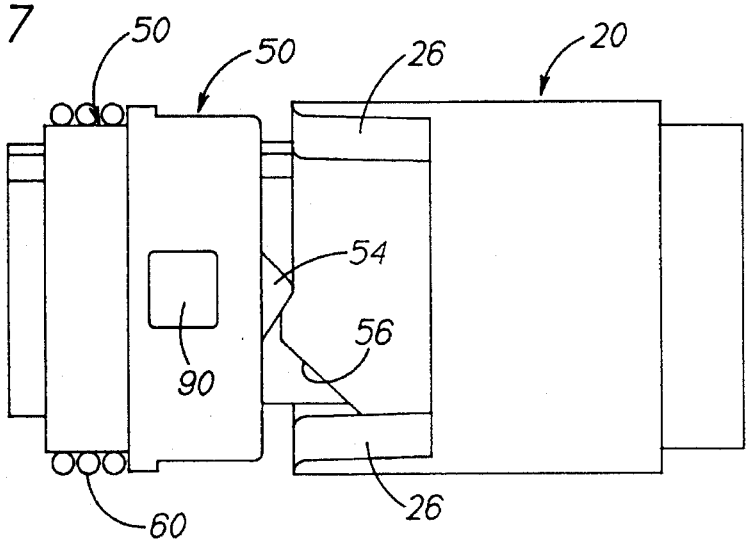
FIG. 7 is a side view showing the cam follower at one extreme position on the cam.
Figure 8:
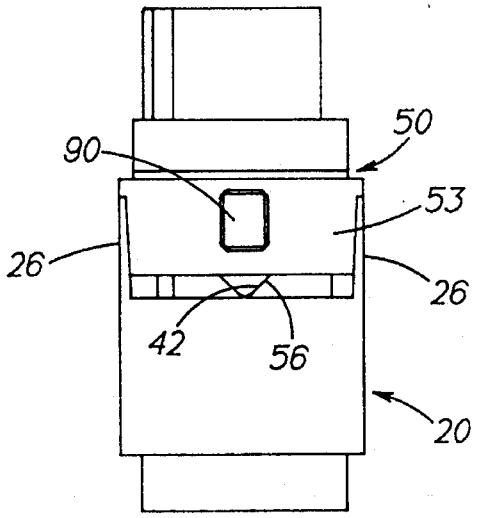
FIG. 8 is a view similar to FIG. 7 showing the follower at a second extreme position on the cam.
Figure 9:
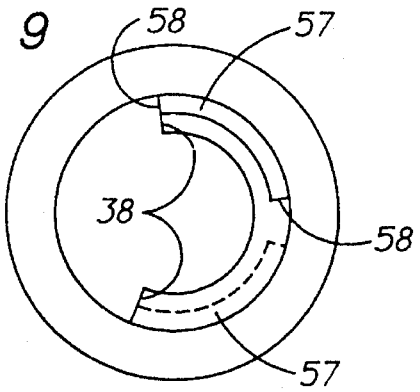
FIG. 9 is a view taken at 9—9 of FIG. 8.

A cylindrical hub 50 (FIGS. 6–9) has a cylindrical portion 52 and a semi cylindrical portion 53 which are slidably displaced onto the enlarged diameter portion 34 of the cam support 32. The hub 50 also has a cam follower 54 having cam following helical surfaces 56 and a base 57 at its forward end which defines axially extending opposed side stop surfaces 58. One of these stop surfaces 58 abuts against one of the cam support steps 38 to define the orientation relationship shown in FIG. 7 and the other stop surface 58 abuts against the second cam support step 38 to define the orientation relationship shown in FIG. 8. FIG. 7 illustrates a decoupled relationship and FIG. 8 shows the coupling of the hub 50 and the coupling 20 (the tangs 26 of the coupler 20 now engage the stop surfaces 55 of the semi cylindrical portion 53 of the hub) so that rotation of the exterior operator will result in rotation of the half round portion to open the latch. A spring 60 biases the hub cam follower 54 against the cam element 40. As can be seen from FIG. 7, the end of the cam element 54 ends with a detent 33 so that after the cam follower helical surface 56 is displaced past the cam surface 42, the pointed end of the cam follower will be pushed into engagement with the detent. This will prevent a change in orientation as a result of vibration or the like.

Figure 10:
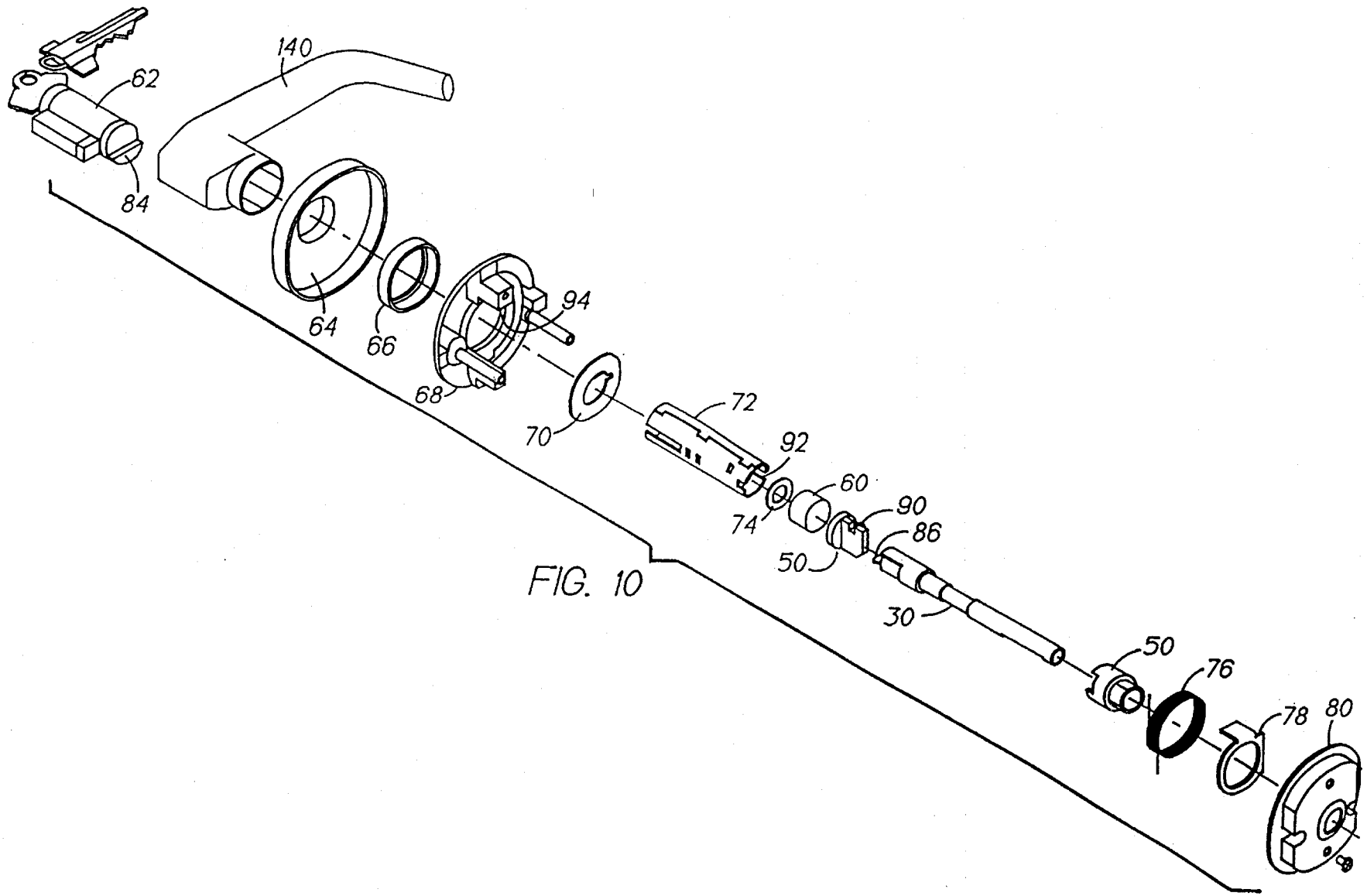
FIG. 10 is an oblique, separated view of a portion of the tubular lock assembly including the exterior operator.

The exterior operator assembly which is shown in FIG. 10 includes an operator (lever or handle) 140 which supports a key operated lock 62, a rose cover 64, a bearing support 66, a rose liner 68, a support washer 70, a sleeve 72, a spring stop plate 74, the spring 60, the hub assembly 50, the cam assembly 30, the coupling 20, a torque spring 76, a torque spring housing 78 and a collar 80.

The plug 63 of the lock 62 has a cross slot 84 for receiving a forwardly projecting tang 86 on the cam support 32 so that rotation of the key 90° from an open position to a lock position will conjointly rotate the cam assembly about its spindle. Such rotation forcefully axially displaces the hub assembly from its coupling position (FIG. 8) to its decoupling position (FIG. 7) where it will be maintained by the detent 33. This detent will be released when the turn button is turned to the open position. The hub pin 90 (FIGS. 6 and 7) is located within a slot 92 in the sleeve 72 which restricts the hub to axial movement. At the decoupling position, this pin 90 is located within an axially extending keyway 94 in the rose liner 68. Since the rose liner is secured to the door, the operator cannot rotate when the door is locked. When the key is rotated 90° to open the door the hub and coupling will interconnect so that turning the exterior operator will retract the latch bolt. In the event a rotative force is applied to the lever sufficient to break the pin off the hub, the rotation of the lever cannot open the latch since the hub is not coupled with the coupling.

The door can also be locked from the inside if the interior operator has a turn button 100 (FIGS. 11 and 12). The turn button has a non round shaft 102 which is received within a matching non round hole 104 in the cam assembly spindle 28. It is retained by a push-on ring 106 and will be held at 90° positions by a spring detent 108.

Figure 15:
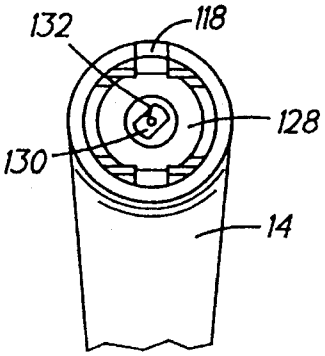
FIG. 15 is a view taken at 15—15 of FIG. 14.
Figure 14:
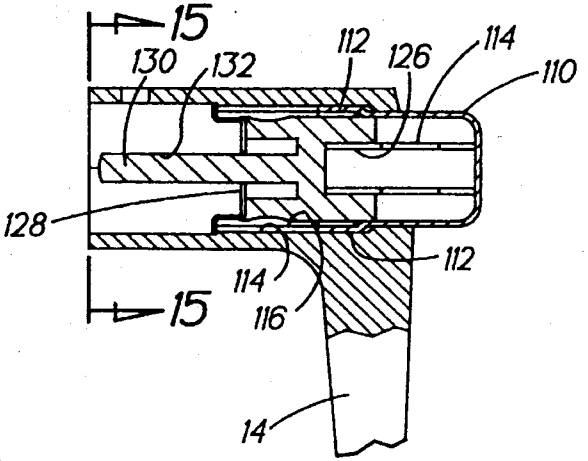
FIG. 14 is a cross-sectional elevational view of the interior operator assembly.
Figure 13:
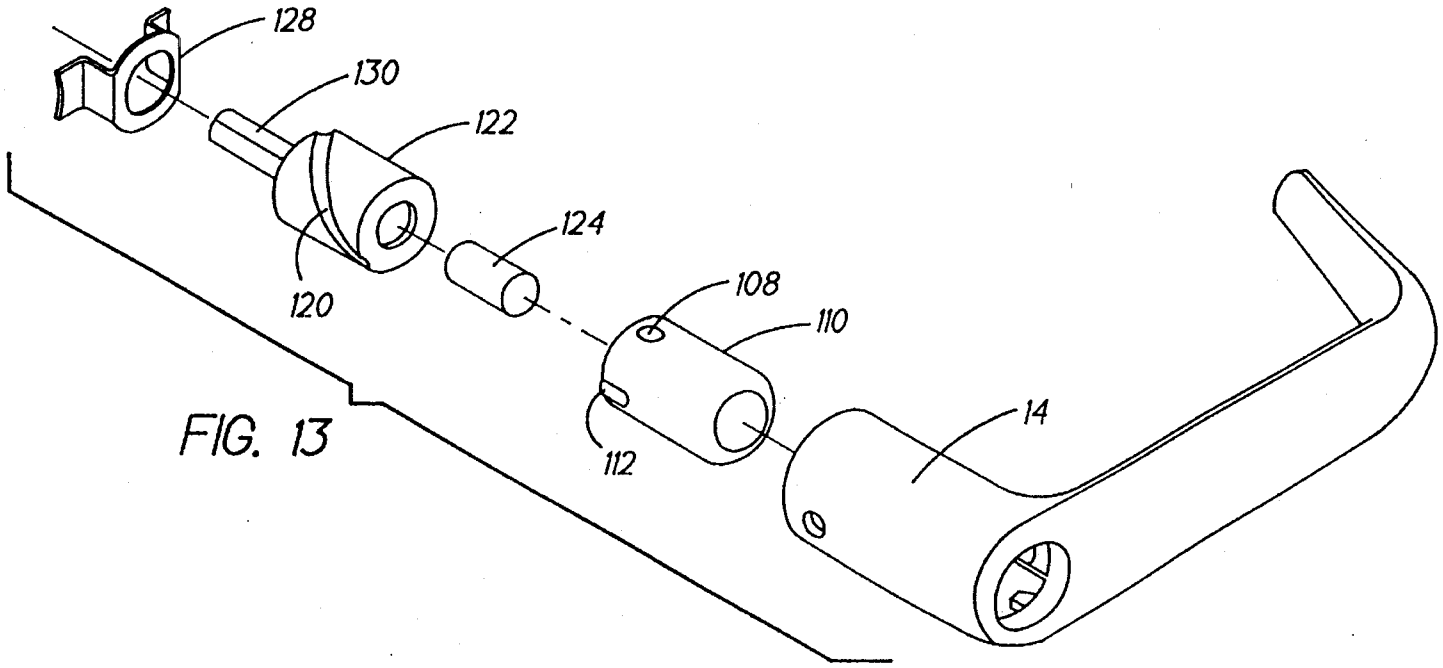
FIG. 13 is an oblique, separated view of the interior operator assembly having a push button.

The door can also be locked from the inside by depressing a push button 110 (FIGS. 13–15). The push button 110 has a pair of opposed keys 112 on the outer cylindrical surface which are received by suitable keyways 114 in the lever bore 116 so that the push button can be advanced without rotation. The push button has an inwardly projecting stake 118 (FIG. 15) which is located within a helical groove 120 in the privacy drive cam 122 around which the push button is located. A compression spring 124 is located within a bore 126 in the privacy drive cam and is compressively positioned between the privacy drive cam 122 and the push button 110. Forward movement of the push button is limited by a stop 128. The privacy drive cam 122 has a forwardly projecting non-round shaft 130 which is received by a matching non-round bore 132 in the cam support spindle 28.

Figure 16:
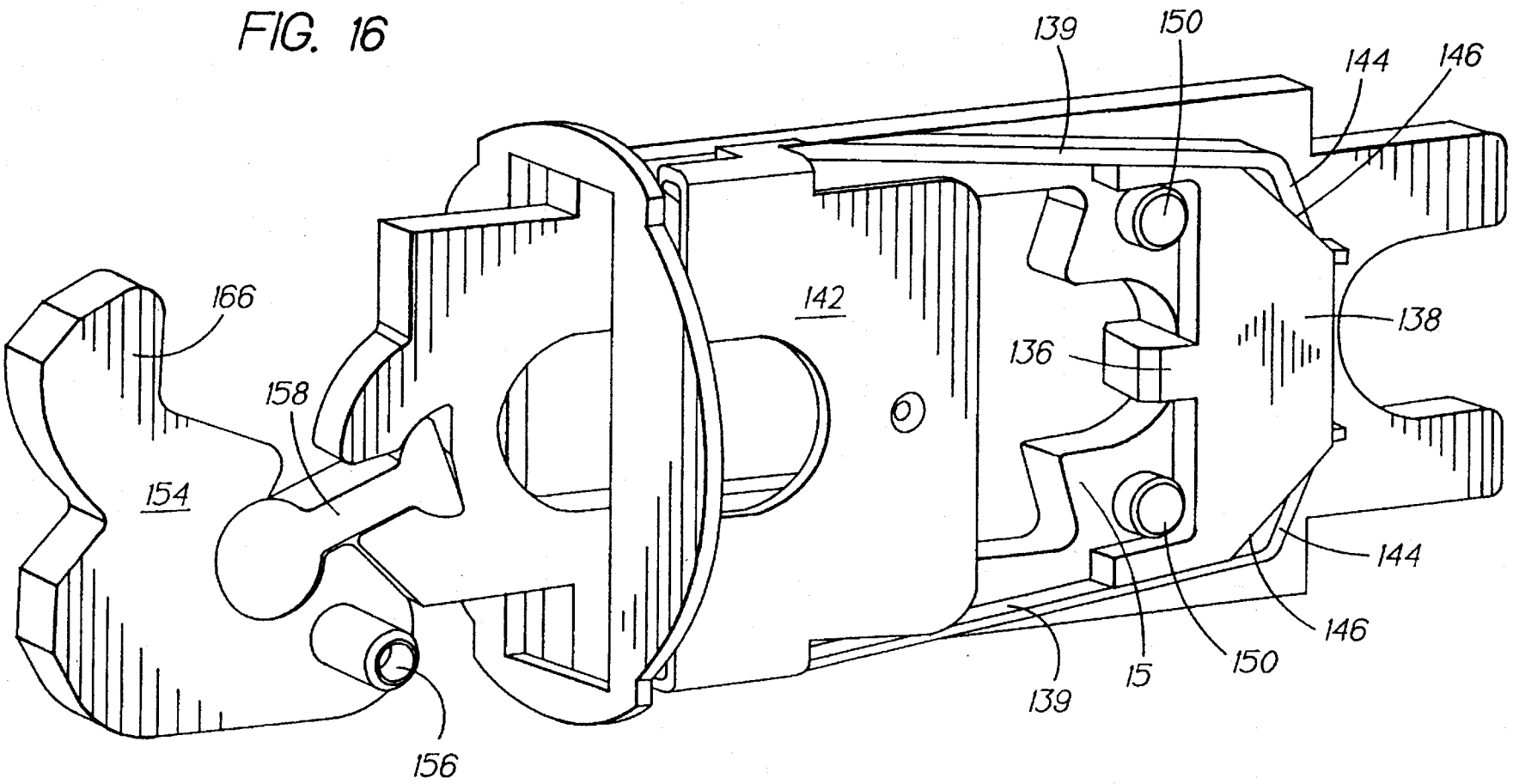
FIG. 16 is an oblique view of the latch mechanism.

The latch assembly is shown in FIGS. 16 and 17. When the privacy button is pushed, the cam support spindle 28 is rotated to present a spindle slot 134 (FIG. 4) to the catch 136 of a slide element 138. The slide element 138 is biased towards the spindle by a pair of springs 139 which are supported by a spring casing 142. These springs have bent ends 144 which engage beveled surfaces 146 on the slide element 138. When the slot 134 faces the catch 136, the springs force the catch into the slot to keep the spindle at the orientation that defines a decoupled condition which locks the exterior operator. The slot 134 and catch 136 accordingly define a detent. This detent can be released in three ways: The interior operator can be rotated to displace the retractor slide 15 which has a pair of posts 150 which will engage and conjointly displace the slide element 138 out of the slot; a person outside the door can insert a suitable unlocking pin into the hole (not shown) in the exterior operator 14 (FIG. 17) to rearwardly displace the emergency actuator 162 within a bore in the spindle which includes the slot (the emergency actuator 162 has an enlarged portion 163 which fills the slot when so displaced to release the catch); and the latch cam 154 which is pivotally supported by a rivet 156 secured to the latch housing will be pivoted, whenever the door is closed, to displace the retractor slide 15 (and hence, the slide element 138) via a link 158 (the upper end 166 of latch cam 154 is received within a suitable opening 170 in the latch bolt 172 which is sized so that it will be effectively filled by the upper end of the cam 166).

I claim:

1. A tubular lock assembly comprising a latch assembly including a laterally displaceable latch slide having abutment means and post means, a detent slide having a detent element, said detent slide slidably displaceable on said latch slide from a remote location to a detent location against said post means, and spring means for urging said detent slide from said remote location towards said detent location, and an interior operator assembly including a rotatable operator, a sleeve secured to said operator and having means for engaging said abutment means so that rotation of said operator will laterally displace said latch slide, and a push button assembly including a push button, and a spindle having a slot for receiving said detent element, means for interconnecting said push button and said operator so that said push button can be axially displaced from an out position to an in position without relative rotation, means for interconnecting said push button and said spindle so that when said push button is axially displaced from said out position to said in position, said spindle will be rotated to an orientation where said detent element will be urged into said slot, whereby said push button will be maintained at said in position when said detent element is in said slot and whereby rotation of said operator will displace said push button from said in position towards said out position and conjointly laterally displace said latch slide to displace said detent slide to withdraw said detent element out of said slot.

2. A tubular lock assembly according to claim 1, wherein said post means comprises a pair of posts, said slide means further comprises opposed forwardly projecting legs for capturing said pair of posts, and opposed inwardly inclined rear surfaces, and said spring means comprises a spring housing and a pair of leaf springs having bent ends for forcefully engaging said inclined rear surfaces as said retractor slide is displaced between said remote and detent location.

3. A tubular lock assembly according to claim 1, further comprising an exterior operator assembly connected to said spindle

4. A tubular lock assembly according to claim 1, further comprising an exterior operator assembly and means for selectively connecting said exterior operating assembly and said spindle.

* * * * *